US011619961B1

(12) United States Patent
Pietri et al.

(10) Patent No.: US 11,619,961 B1
(45) Date of Patent: Apr. 4, 2023

(54) BANDGAP REFERENCE COMPENSATION CIRCUIT

(71) Applicant: NXP USA, Inc., Austin, TX (US)

(72) Inventors: Stefano Pietri, Austin, TX (US); John Pigott, Phoenix, AZ (US)

(73) Assignee: NXP USA, Inc., Austin, TX (US)

( * ) Notice: Subject to any disclaimer, the term of this patent is extended or adjusted under 35 U.S.C. 154(b) by 0 days.

(21) Appl. No.: 17/645,871

(22) Filed: Dec. 23, 2021

(51) Int. Cl.
*G05F 3/30* (2006.01)
*G05F 3/16* (2006.01)

(52) U.S. Cl.
CPC ..... *G05F 3/16* (2013.01); *G05F 3/30* (2013.01)

(58) Field of Classification Search
None
See application file for complete search history.

(56) References Cited

U.S. PATENT DOCUMENTS 7,283,010 B2 10/2007 Seefeldt
7,683,701 B2 3/2010 Georgescu et al.
8,680,839 B2 * 3/2014 Venkiteswaran S. ..... G05F 3/30 323/311
8,692,584 B2 4/2014 Nakamura et al.
10,268,226 B1 * 4/2019 Wang ..... G05F 3/30
10,284,206 B2 * 5/2019 Itasaka ..... H03L 1/028
10,992,259 B2 * 4/2021 Zhang ..... H03B 5/24
11,385,669 B2 * 7/2022 Nome Silva ..... G05F 3/30

OTHER PUBLICATIONS

Banba, H. et al. "A CMOS Bandgap Reference Circuit with Sub-1-V Operation", IEEE Journal of Solid-State Circuits, vol. 34, No. 5, pp. 670-674 (May 5, 1999).
Kuijk, E. K. "A Precision Reference Voltage Source", IEEE Journal of Solid-State Circuits, vol. SC-8, No. 3, pp. 222-226 (Jun. 1973).
Khashaba, A. et al. "A 34 μW 32MHz RC Oscillator with ±530ppm Inaccuracy from −40° C. to 85° C. and 80ppm/V Supply Sensitivity Enabled by Pulse-Density Modulated Resistors", IEEE 2020 International Solid-State Circuits Conference, 3 pgs. (2020).

* cited by examiner

*Primary Examiner* — Jeffery S Zweizig

(57) ABSTRACT

A bandgap reference correction circuit comprising a bandgap reference circuit comprising a first resistor; a first oscillator comprising a second resistor, wherein a frequency of a first oscillator output signal of the first oscillator depends on a resistance of the second resistor; and a compensation module configured to: receive the first oscillator output signal from the first oscillator and a reference frequency signal from a reference oscillator; determine the frequency of the first oscillator output signal using the reference frequency signal; and set a resistance of the first resistor based on the frequency of the first oscillator output signal.

20 Claims, 4 Drawing Sheets

BANDGAP REFERENCE COMPENSATION CIRCUIT

FIELD

The present disclosure relates to bandgap reference circuits and in particular to an apparatus and method for compensating resistance errors in a bandgap reference circuit.

SUMMARY

According to a first aspect of the present disclosure there is provided a bandgap reference correction circuit comprising:

a bandgap reference circuit comprising a first resistor;

a first oscillator comprising a second resistor, wherein a frequency of a first oscillator output signal of the first oscillator depends on a resistance of the second resistor; and a compensation module configured to:

receive the first oscillator output signal from the first oscillator and a reference frequency signal from a reference oscillator;

determine the frequency of the first oscillator output signal using the reference frequency signal; and set a resistance of the first resistor based on the frequency of the first oscillator output signal.

In one or more embodiments the first resistor may be adjacent to, proximal to or co-located with the second resistor on a semiconductor die.

In one or more embodiments the first resistor may comprise a first resistor array. The second resistor may comprise a second resistor array. The first resistor array may be interdigitated with the second resistor array.

In one or more embodiments, the first resistor and the second resistor may both comprise a p-type semiconductor or both comprise a n-type semiconductor.

In one or more embodiments, the bandgap reference correction circuit may be configured to provide a first current to the first resistor and a second current to the second resistor. The first current and the second current may have the same order of magnitude.

In one or more embodiments, the first oscillator may comprises a temperature compensation module configured to set an effective resistance of the second resistor based on a temperature of the bandgap reference correction circuit.

In one or more embodiments, the first oscillator may comprise a fifth resistor in parallel to the second resistor, wherein the fifth resistor is of a different type to the second resistor. The temperature compensation circuit may be configured to selectively enable the second resistor and the fifth resistor to maintain a constant effective resistance of the first oscillator in response to temperature variation.

In one or more embodiments, the bandgap reference circuit may further comprise a third resistor. The compensation module may be configured to set a resistance of the third resistor based on the frequency difference.

In one or more embodiments, the first resistor and the third resistor may form at least part of a bandgap resistor array and the second resistor may be interdigitated with the bandgap resistor array.

In one or more embodiments, the first resistor and the third resistor may both comprise a p-type semiconductor or both comprise a n-type semiconductor.

In one or more embodiments, the compensation module may comprise:

a counter comprising:

an input terminal configured to receive the first oscillator output signal;

a reset terminal configured to receive the reference frequency signal;

and an output signal configured to output a count value of the counter; and a digital compensation module configured to:

receive the count value of the counter from the counter; and set the resistance of the first resistor based on the frequency of the first oscillator output signal.

In one or more embodiments, the digital compensation module may be configured to determine the frequency of the first oscillator output signal based on the count value.

In one or more embodiments, the first oscillator may be a free running oscillator.

In one or more embodiments, the reference oscillator may comprise any one of:

a crystal oscillator;

a LC oscillator; and a MEMS oscillator.

In one or more embodiments, the bandgap reference correction circuit may further comprise the reference oscillator.

In one or more embodiments, the compensation module may be configured to set a resistance of the first resistor based on the frequency of the first oscillator output signal to output a constant reference voltage from the bandgap reference circuit.

According to a second aspect of the present disclosure, there is provided an integrated circuit comprising any of the bandgap reference compensation circuits disclosed herein.

According to a third aspect of the present disclosure, there is provided a bandgap reference correction circuit comprising:

a bandgap reference circuit comprising a first resistor;

a first oscillator comprising a second resistor, wherein a frequency of a first oscillator output signal of the first oscillator depends on a resistance of the second resistor; and a compensation module configured to:

detect frequency changes of the first oscillator output signal; and adjust a resistance of the first resistor based on the frequency changes.

In one or more embodiments, the first resistor may be adjacent to, proximal to or co-located with the second resistor on a semiconductor die.

According to a fourth aspect of the present disclosure, there is provided a method for controlling a reference voltage of a bandgap reference circuit, the method comprising:

receiving a first oscillator output signal from a first oscillator, wherein a frequency of the first oscillator output signal depends on a resistance of a second resistor of the oscillator;

receiving a reference frequency signal from a reference oscillator;

determining the frequency of the first oscillator output signal using the reference frequency signal; and setting a resistance of a first resistor of a bandgap reference circuit based on the frequency of the first oscillator output signal.

In one or more embodiments, the first resistor is adjacent to, proximal to or co-located with the second resistor on a semiconductor die.

While the disclosure is amenable to various modifications and alternative forms, specifics thereof have been shown by way of example in the drawings and will be described in detail. It should be understood, however, that other embodiments, beyond the particular embodiments described, are possible as well. All modifications, equivalents, and alternative embodiments falling within the spirit and scope of the appended claims are covered as well.

The above discussion is not intended to represent every example embodiment or every implementation within the scope of the current or future Claim sets. The figures and Detailed Description that follow also exemplify various example embodiments. Various example embodiments may be more completely understood in consideration of the following Detailed Description in connection with the accompanying Drawings.

BRIEF DESCRIPTION OF THE DRAWINGS

One or more embodiments will now be described by way of example only with reference to the accompanying drawings in which.

DETAILED DESCRIPTION

High-precision bandgap references are a basic building block used in many integrated circuits (ICs) and systems that require a reference voltage. Example bandgap reference circuits include the Kuijk bandgap reference circuit and the Banba bandgap reference circuits. Bandgap reference circuits may employ one or more resistors which may be arranged in a resistor array (of fingers or elements or segments) on a semiconductor die. The resistors should maintain a constant resistance (or at least a predictable resistance, for example with respect to temperature changes) during operation. Poly-silicon resistors (or poly-resistors) may be used in bandgap reference circuits as precision resistors, however their resistance can vary with temperature and mechanical stress.

Figure 1:
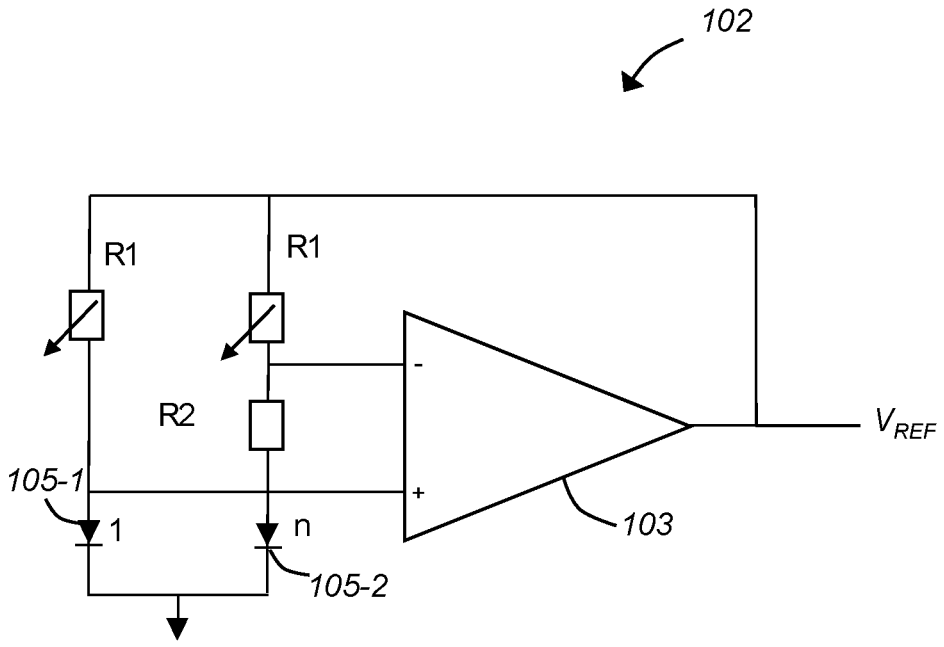
FIG. 1 shows an example bandgap reference circuit.

A known bandgap reference circuit 102, known as a delta VBE (ΔVbe) cell, is shown in FIG. 1. The delta VBE bandgap reference circuit includes an operational amplifier 103, polysilicon resistors, R1, R2, and diodes 105-1 and 105-2 arranged as shown to produce a supply voltage-independent reference voltage, $V_{REF}$. The bandgap reference circuit 102 can use the precision poly-resistors, R1, R2, to generate a stable, supply voltage independent reference voltage, $V_{REF}$, approximately equal to:

$$V_{REF} = V_{be} + \frac{R1}{R2}\Delta V_{be}$$

where, $V_{be}$ is the forward voltage of the diode 105-1 and $\Delta V_{be}$ is the difference in forward voltages of the diodes 105-1 and 105-2 when biased at different current densities. This difference is k·T/q*ln(n) where k is Boltzmann's constant; T is the temperature in Kelvin; q is the charge on an electron; and 'n' is the ratio of current densities between the diodes 105-1, 105-2 (n may be set by a size ratio between the two diodes 105-1, 105-2).

Pressure or bending applied to the resistor will cause a resistance change in R1 and R2. Mechanical stress may be applied to the poly-resistor(s) during any of: wafer cutting, wire bonding or ball deposition, injection of plastic mold around the semiconductor die during packaging, soldering and any life event that will apply pressure of folding forces to the semiconductor die. The mechanical stress can alter the resistance of the poly-resistors, R1, R2, resulting in the bandgap reference circuit outputting an inaccurate reference voltage, $V_{REF}$. Mechanical stress may lead to errors in the resistance and/or the reference voltage of a few %.

Even if R1 and R2 are matched and common centroid the absolute difference in the resistance of R1 and R2 will cause a drift in the band gap reference voltage, $V_{REF}$, that is outside of the control of the manufacturer.

During manufacture, the reference voltage, $V_{REF}$, may be measured and the resistance of one or both poly-resistors, R1, R2, adjusted (or trimmed) to provide a desired value of the reference voltage, $V_{REF}$. The bandgap reference circuit may include a temperature compensation circuit that can adjust the resistance of one or both poly-resistors based on a temperature of the circuit, for example a chip temperature. However, the reference voltage, $V_{REF}$, may drift further during packaging and/or operation as stress is applied to the poly-resistors, R1, R2.

Apparatus and methods of the present disclosure enable detection of variation in resistance that a resistor of a bandgap reference circuit will experience throughout its life (due to mechanical stress or aging, for example) and correction of the variation in resistance to maintain a constant reference voltage, $V_{REF}$.

Figure 2:
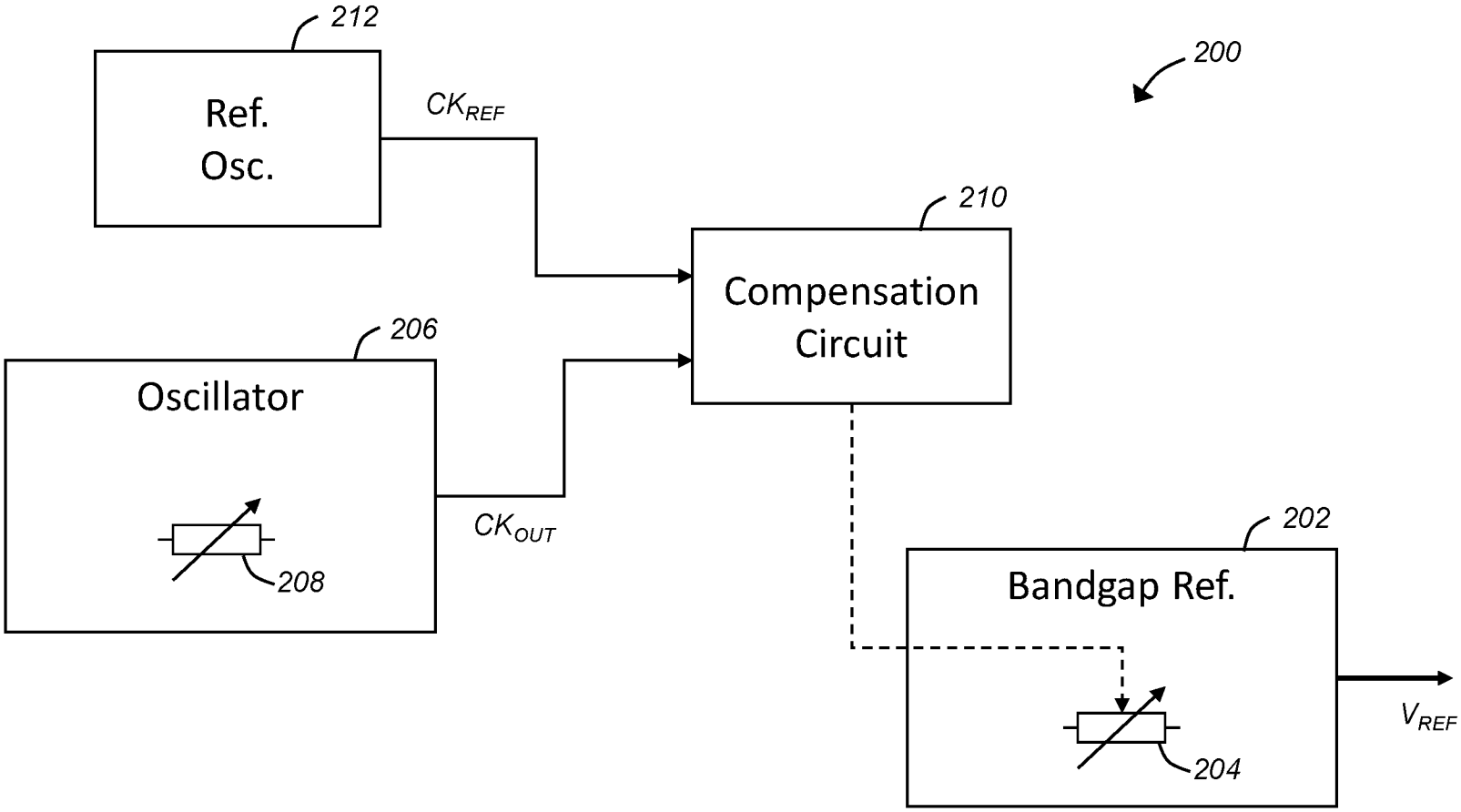
FIG. 2 shows an example bandgap reference compensation circuit according to an embodiment of the present disclosure.

FIG. 2 illustrates a bandgap reference compensation circuit (BRCC) 200 according to an embodiment of the present disclosure.

The BRCC 200 includes a bandgap reference circuit 202 comprising a first resistor 204. The bandgap reference circuit 202 can output a fixed reference voltage, $V_{REF}$, to other circuitry. The BRCC 200 further comprises a first oscillator 206 (also referred to herein as simply the oscillator) comprising a second resistor 208. A frequency of a first oscillator output signal, $CK_{OUT}$, (also referred to herein as simply the oscillator output signal) of the oscillator 206 depends upon a resistance of the second resistor 208. The BRCC 200 further comprises a compensation module 210. The compensation module 210 receives the oscillator output signal, $CK_{OUT}$, from the oscillator 206. The compensation module 210 also receives a reference frequency signal, $CK_{REF}$, from a reference oscillator 212. The compensation module 210 can determine a frequency of the oscillator output signal, $CK_{OUT}$, using the reference frequency signal, $CK_{REF}$. The compensation module 210 can set a resistance of the first resistor 204 based on the frequency of the oscillator output signal, $CK_{OUT}$. In other words, the compensation module 210 can detect changes in the frequency of the oscillator output signal, $CK_{OUT}$, and adjust or set the resistance of the first resistor 204 to maintain a constant reference voltage, $V_{REF}$.

By measuring the frequency of the oscillator output signal, relative to the stable reference frequency, it's possible to use the drift in the frequency of the oscillator output signal to compensate the response of the reference voltage, $V_{REF}$, to stress effects and keep the reference voltage, $V_{REF}$, calibrated (in the background), even when the BRCC 200 is in the field, and without any downtimes associated with re-calibration or taking accurate measurements of the reference voltage.

The BRCC 200 may include a memory (not shown) for storing calibration data. The calibration data may be captured as part of a calibration routine during manufacturing. The calibration data may correspond to one or more of: calibration of the frequency response of the oscillator output signal, $C_{KOUT}$, to a change in resistance of the second resistor 208; calibration of the reference voltage, $V_{REF}$, to a change in resistance of the first resistor 204; and calibration of the compensation module 210 to determine a relationship (or gain factor) between a detected frequency of the oscillator output signal, $C_{KOUT}$, and a resistance of the first resistor 204 (or a value of the reference voltage, $V_{REF}$). The calibration data may be stored as look-up data and/or relationship curve data in the memory. In this way, the compensation module 210 can set the resistance of the first resistor 204 to maintain a constant reference voltage, $V_{REF}$, based on the detected frequency of the oscillator output signal, $C_{KOUT}$, and the predetermined calibration data.

In some examples, the first resistor 204 is positioned adjacent to, proximal to or co-located with the second resistor 208 on a semiconductor die. In this way, the two resistors may be subject to the same stress or other variation. The first resistor 204 may comprise a first resistor array of resistor fingers and the second resistor 208 may comprise a second resistor array. The first resistor array may be interdigitated with the second resistor array. However, the first resistor array and the second resistor array do not necessarily have the same length, for example, the first resistor array may have 10 fingers and the second resistor array may have 5 fingers. In some examples, the first resistor array and the second resistor array may have the same centroid.

In some examples, the first resistor 204 and the second resistor 208 are of the same type. In other words, the first resistor 204 and the second resistor 208 both comprise a p-type semiconductor (p-poly-resistors) or both comprise a n-type semiconductor (n-poly-resistors). In some examples, the first resistor 204 and the second resistor 208 may have the same designed resistance value.

By co-locating the first resistor 204 with the second resistor 208 and/or providing both resistors 204, 208 as the same type, the first resistor 204 and the second resistor 208 will undergo a substantially similar response to perturbation, for example a related change in resistance value to mechanical stress.

In some examples, the BRCC 200 may be configured to provide a first current to the first resistor 204 and a second current to the second resistor 208, wherein the first current and the second current are of the same order of magnitude. In this way, both the first resistor 204 and the second resistor 208 will be exposed to substantially similar aging effects and any adjustments made by the compensation module 210 to the first resistor 204 as a result of detected changes in the frequency of the oscillator output signal, $CK_{OUT}$, will also account for these aging effects.

Figure 5:
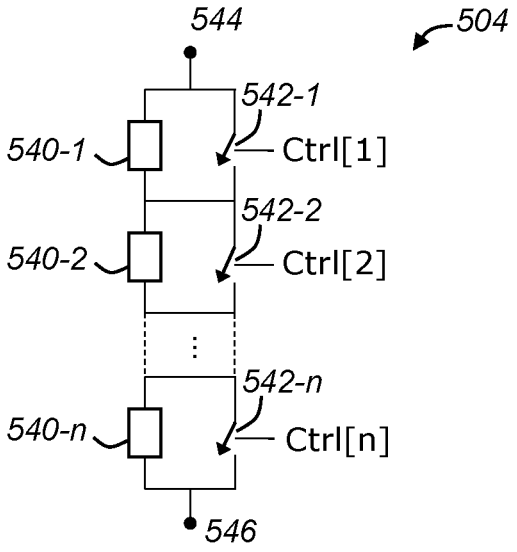
FIG. 5 shows a resistor for a bandgap reference compensation circuit according to an embodiment of the present disclosure.

FIG. 5 illustrates an example first resistor 504 for the BRCC according to an embodiment of the present disclosure.

In this example, the first resistor 504 comprises a digitally adjustable resistor in the form of a resistor array. The first resistor 504 comprises an array of resistor elements 540-1, 540-2 . . . **540-*n* connected in series between a first resistor terminal 544 and a second resistor terminal 546. Each resistor element 540-1, 540-2 . . . 540-*n* has a respective resistor switch 542-1, 542-2 . . . 542-*n* connected in series. The resistor switches 542-1, 542-2 . . . 542-*n* can selectively enable their corresponding resistor element 540-1, 540-2 . . . 540-*n* in response to a corresponding resistor control signal Ctrl[1], Ctrl[2] . . . Ctrl[n]. When a resistor switch 542-1, 542-2 . . . 542-*n* is closed, the corresponding resistor element 540-1, 540-2 . . . 540-*n* is short circuited and does not contribute to the resistance of the first resistor 504. When a resistor switch 542-1, 542-2 . . . 542-*n* is open, the corresponding resistor element 540-1, 540-2 . . . 540-*n* is in the path between the first resistor terminal 544 and the second resistor terminal 546 and does contribute to the resistance of the first resistor 504. The resistor control signals may be provided by the compensation module of the BRCC. In this way, the compensation module can set the resistance of the first resistor 504**.

Any of the second resistor and third to fifth resistors (discussed below) may also have a similar arrangement to the first resistor of FIG. 5. Such resistors may or may not be trimmable and may or may not include resistor switches accordingly. As described above, the resistor elements 540-1, 540-2 . . . **540-*n* of the first resistor 504** may be interdigitated with resistor elements of the second resistor array.

Returning to FIG. 2, the oscillator 206 may comprise any resistance based oscillator. In some examples, the oscillator 206 is a free running oscillator. The oscillator 206 may be a RC oscillator with a fixed capacitance. In some examples the oscillator 206 can have a reduced sensitivity to temperature changes. For example, a range of variation of the frequency over the operating temperature range may be at least an order of magnitude less than the range of variation of the frequency arising from any anticipated stress applied to the second resistor 208. In some examples, the oscillator 206 may comprise a temperature compensation circuit. The temperature compensation circuit may adjust the oscillator 206 to reduce a temperature variation of the frequency of the oscillator output signal, $CK_{OUT}$. A specific example of temperature compensation is described below in relation to FIG. 3.

The reference oscillator 212 can provide a constant clock reference for the compensation module 210. The reference oscillator 212 may include any precision oscillator. The reference oscillator 212 may have a sensitivity to temperature and stress that is at least an order of magnitude less than the sensitivity of the oscillator 206. The reference oscillator 212 may comprise any one of: a crystal oscillator, a LC (inductor-capacitor) oscillator and a MEMS (micro-electro-mechanical system) oscillator. In some examples the BRCC 200 may include the reference oscillator 212. In other examples, the reference oscillator 212 may be located external to the BRCC 200 and the compensation module 210 can receive the reference frequency signal, $CK_{REF}$, from the external reference oscillator 212.

The compensation module 210 may set or adjust the resistance of the first resistor 204 by trimming the first resistor 204. Trimming the first resistor 204 may comprise setting a number of active fingers or elements or segments in a first resistor array.

In some examples, the oscillator 206 and/or the compensation module 210 may run continuously while the bandgap reference circuit 202 is powered on. In other examples, the oscillator 206 and/or the compensation module 210 may only operate intermittently to perform a check for stress in the second resistor 208 and correct the first resistor 204 accordingly. Intermittent operation may correspond to a single check post-packaging of the IC comprising the BRCC 200 or periodic checking during the operational lifetime of the IC. Intermittent operation can reduce a power consumption of the BRCC 200.

Figure 3:
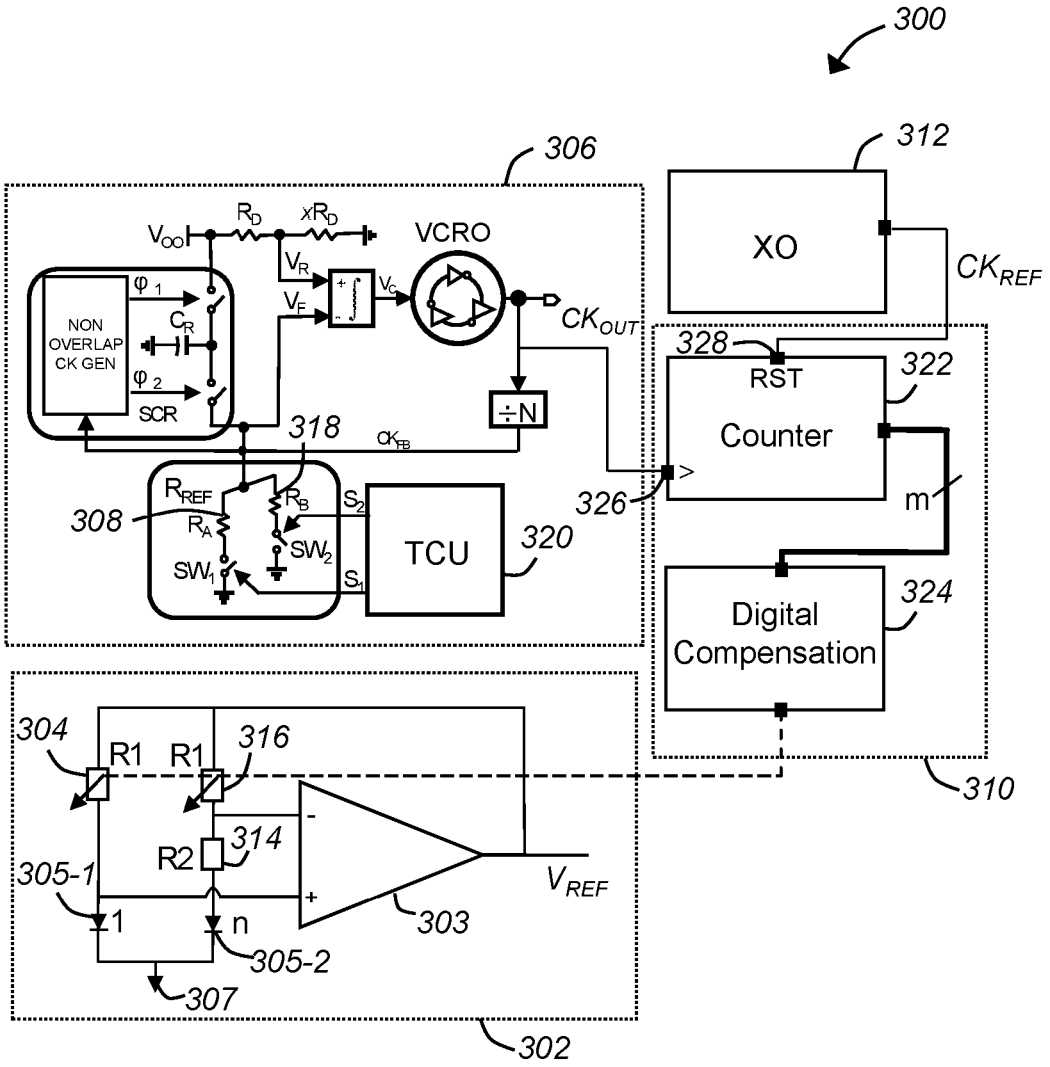
FIG. 3 shows another example bandgap reference compensation circuit according to an embodiment of the present disclosure.

FIG. 3 illustrates a more detailed example of a BRCC 300 according to an embodiment of the present disclosure. Features of FIG. 3 that are also present in FIGS. 1 and 2 have been give corresponding numbers in the 300 series and will not necessarily be described again here.

In this example, the bandgap reference circuit 302 comprises the same form as the bandgap reference circuit of FIG. 1. The bandgap reference circuit is a Kuijk bandgap reference circuit. The bandgap reference circuit 302 comprises an operational amplifier (op-amp) 303, wherein an output terminal of the op-amp 303 provides the reference voltage, $V_{REF}$. The first resistor 304 is coupled between the output terminal of the op-amp 303 and a non-inverting input terminal of the op-amp 303. A first diode 305 is coupled between the non-inverting input terminal of the op-amp 303 and a reference terminal 307, which in this example is a ground terminal. A fourth resistor 316 is coupled between the output terminal of the op-amp 303 and an inverting input of the op-amp 303. A third resistor 314 is coupled between the inverting input terminal of the op-amp 303 and an anode of a second diode 305-2. A cathode of the second diode 305-2 is coupled to the reference terminal 307. Operation principles of the Kuijk bandgap circuit that provide a fixed reference voltage, $V_{REF}$, are known in the art and not described here.

In this example, the first resistor 304 and the fourth resistor 316 are both variable resistors in that their resistance can be trimmed. The compensation module 310 is configured to set the resistance of the first resistor 304 and/or the fourth resistor 316 to maintain a constant reference voltage, $V_{REF}$, based on the detected frequency of the oscillator output signal, $CK_{OUT}$. In other examples, the compensation module 310 may alternatively, or in addition, set the resistance of the third resistor 314 to maintain a constant reference voltage, $V_{REF}$, based on the detected frequency of the oscillator output signal, $CK_{OUT}$. In this example, the first resistor 304, the third resistor 314 and the fourth resistor 316 of the bandgap reference circuit 302 and the second resistor 308 of the oscillator 306 are all of the same type (n-type/p-type).

The first resistor 304, the third resistor 314 and the fourth resistor 316 may together form a bandgap resistor array on the semiconductor die. The second resistor 308 may be interdigitated with the bandgap resistor array. As a result, all four resistors (of the same type) can undergo a similar response to any applied mechanical stress. In this way, the second resistor 308 may be considered as a replica of one or more of the first resistor 304, the third resistor 314 and the fourth resistor 316.

In this example, the oscillator 306 is a free running oscillator. The oscillator 306 is particularly insensitive to temperature variation. The oscillator 306 is based on the oscillator described in detail in Khashaba, et al, "*3.5 A 34μW 32 MHz RC Oscillator with ±530 ppm Inaccuracy from −40° C. to 85° C. and 80 ppm/V Supply Sensitivity Enabled by Pulse-Density Modulated Resistors,*" 2020 *IEEE International Solid-State Circuits Conference—(ISSCC)*, 2020, pp. 66-68, doi: 10.1109/ISSCC19947.2020.9062942, and will therefore not be described in full detail here.

The oscillator 306 includes a fifth resistor, $R_B$, 318 in parallel with the second resistor, $R_A$, 308. The oscillator 306 also includes a temperature compensation unit, TCU, 320 configured to control a first switch, $SW_1$, in series with the second resistor 308 and a second switch, $SW_2$, in series with the fifth resistor 318. In this way, the temperature compensation unit 320 can selectively enable the second resistor 308 and the fifth resistor 318 to control an effective resistance of the oscillator 306. The fifth resistor 318 is of a different type to the second resistor 308 (and the first, third and fourth resistors) and therefore has a different response to temperature. As a result, the temperature control unit 320 can selectively enable the second resistor 308 and the fifth resistor 318 to maintain a constant effective resistance of the oscillator 306 in response to a variation in chip temperature. In this way, the frequency of the oscillator output signal, $CK_{OUT}$, is particularly insensitive to temperature variation such that any detected variation in frequency can be attributed to mechanical stress altering the resistance of the second resistor 308 (stress effects on the fifth resistor 318 can be assumed negligible or similar to the effects on the second resistor 308 and accounted for).

In this example, the compensation module 312 includes a counter 322 and a digital compensation module 324. The counter 322 comprises an input terminal 326 that receives the oscillator output signal, $CK_{OUT}$, and a reset terminal 328 that receives the frequency reference signal, $CK_{REF}$. In this way, the counter 322 is clocked by the oscillator output signal, $CK_{OUT}$.

The frequency reference signal, $CK_{REF}$, may comprise a frequency that is one or more orders of magnitude less than the frequency of the oscillator output signal, $CK_{OUT}$. For example, the reference frequency signal, $CK_{REF}$, may have a frequency of 32 kHz and the oscillator output signal, $CK_{OUT}$, may have a (nominal) frequency of 100 MHz. As a result, the counter will nominally cycle from 0 to 3124 counts of the oscillator output signal, $CK_{OUT}$, between each reset signal from the reference frequency signal, $CK_{REF}$. The counter 322 outputs the count value, m, to the digital compensation module 324.

The digital compensation module 324 can monitor the maximum value of the count value, m, to determine the frequency of the oscillator output signal, $CK_{OUT}$. For example, if the frequency of the oscillator output signal, $CK_{OUT}$, drops to 99 MHz, the count value will only reach a maximum of 3093. Similarly, if the frequency of the oscillator output signal, $CK_{OUT}$, increases to 101 MHz, the count value will reach a maximum of 3156.

In a real system, the nominal values of the frequencies of the oscillator output signal, $CK_{OUT}$, and the reference frequency signal, $CK_{REF}$, may vary, for example due to manufacturing tolerances. Therefore, the BRCC 300 can determine an initial value of the maximum of the count value, m, corresponding to nominal operation of the oscillator 306 as part of the calibration routine. The BRCC 300 can also selectively enable the second resistor 308 and the fifth resistor 318 to determine a relationship between the maximum count value, m, and the resistance of the second resistor 308. The BRCC 300 can store the initial value and relationship data as part of the calibration data described above.

The digital compensation module 324 can set the resistance of the first resistor 304 based on the maximum count value, m, and the calibration data to maintain a constant reference voltage, $V_{REF}$, of the bandgap reference circuit 302. In this way, the compensation module 310 compares the frequency of the oscillator output signal, $CK_{OUT}$, to the frequency of the reference frequency signal, $CK_{REF}$, to determine and correct a resistance drift of the second resistor 308 and the first resistor 304.

The BRCC 300 measures the frequency of the oscillator 306 with the counter 322 and the stable reference of the reference oscillator 312. By correcting the count value for an initial condition and gain adjustment (calibration), the digital compensation module 324 can use the drift in the frequency of the oscillator output signal, $CK_{OUT}$, to compensate the reference voltage, $V_{REF}$, for stress effects and maintain a constant value.

Figure 4:
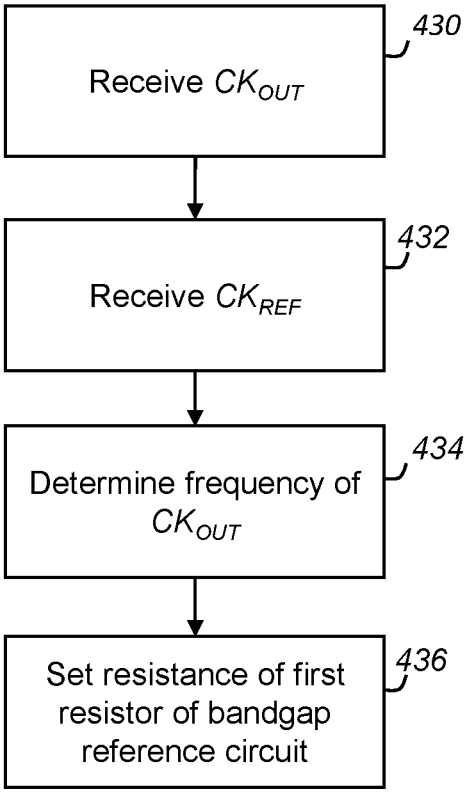
FIG. 4 shows a method for controlling a reference voltage of a bandgap reference circuit according to an embodiment of the present disclosure.

FIG. 4 illustrates a method for controlling a reference voltage of a bandgap reference circuit.

A first step 430 comprises receiving an oscillator output signal from an oscillator, wherein a frequency of the oscillator output signal depends on a resistance of a second resistor of the oscillator.

A second step 432 comprises receiving a reference frequency signal from a reference oscillator.

A third step 434 comprises determining the frequency of the oscillator output signal using the reference frequency signal.

A fourth step 436 comprises setting a resistance of a first resistor of a bandgap reference circuit based on the frequency of the oscillator output signal.

It will be appreciated that the present disclosure is not limited to the type of oscillator or bandgap reference circuit or the implementation method of determining the frequency of the oscillator output signal and other implementations are envisaged within the scope of the present disclosure.

The disclosed apparatus and methods use the frequency of an oscillator to correct bandgap reference voltage drift due to poly-resistor mechanical stress effects. The disclosed circuits and methods can accurately measure a resistance drift by transducing the resistance to the time domain in the form of the frequency of the oscillator output signal.

The disclosed apparatus and methods use a replica of a resistor of the bandgap reference circuit as reference for a temperature and voltage compensated oscillator. As a result, the frequency of the oscillator varies according to the stress applied to the resistor of the bandgap reference circuit at any time.

The instructions and/or flowchart steps in the above figures can be executed in any order, unless a specific order is explicitly stated. Also, those skilled in the art will recognize that while one example set of instructions/method has been discussed, the material in this specification can be combined in a variety of ways to yield other examples as well, and are to be understood within a context provided by this detailed description.

In some example embodiments the set of instructions/method steps described above are implemented as functional and software instructions embodied as a set of executable instructions which are effected on a computer or machine which is programmed with and controlled by said executable instructions. Such instructions are loaded for execution on a processor (such as one or more CPUs). The term processor includes microprocessors, microcontrollers, processor modules or subsystems (including one or more microprocessors or microcontrollers), or other control or computing devices. A processor can refer to a single component or to plural components.

In other examples, the set of instructions/methods illustrated herein and data and instructions associated therewith are stored in respective storage devices, which are implemented as one or more non-transient machine or computer-readable or computer-usable storage media or mediums. Such computer-readable or computer usable storage medium or media is (are) considered to be part of an article (or article of manufacture). An article or article of manufacture can refer to any manufactured single component or multiple components. The non-transient machine or computer usable media or mediums as defined herein excludes signals, but such media or mediums may be capable of receiving and processing information from signals and/or other transient mediums.

Example embodiments of the material discussed in this specification can be implemented in whole or in part through network, computer, or data based devices and/or services. These may include cloud, internet, intranet, mobile, desktop, processor, look-up table, microcontroller, consumer equipment, infrastructure, or other enabling devices and services. As may be used herein and in the claims, the following non-exclusive definitions are provided.

In one example, one or more instructions or steps discussed herein are automated. The terms automated or automatically (and like variations thereof) mean controlled operation of an apparatus, system, and/or process using computers and/or mechanical/electrical devices without the necessity of human intervention, observation, effort and/or decision.

It will be appreciated that any components said to be coupled may be coupled or connected either directly or indirectly. In the case of indirect coupling, additional components may be located between the two components that are said to be coupled.

In this specification, example embodiments have been presented in terms of a selected set of details. However, a person of ordinary skill in the art would understand that many other example embodiments may be practiced which include a different selected set of these details. It is intended that the following claims cover all possible example embodiments.

The invention claimed is:

1. A bandgap reference correction circuit comprising:

a bandgap reference circuit comprising a first resistor;

a first oscillator comprising a second resistor, wherein a frequency of a first oscillator output signal of the first oscillator depends on a resistance of the second resistor; and a compensation module configured to:

receive the first oscillator output signal from the first oscillator and a reference frequency signal from a reference oscillator;

determine the frequency of the first oscillator output signal using the reference frequency signal; and set a resistance of the first resistor based on the frequency of the first oscillator output signal.

2. The bandgap reference correction circuit of claim 1, wherein the first resistor is adjacent to, proximal to or co-located with the second resistor on a semiconductor die.

3. The bandgap reference correction circuit of claim 1, wherein:

the first resistor comprises a first resistor array;

the second resistor comprises a second resistor array; and the first resistor array is interdigitated with the second resistor array.

4. The bandgap reference correction circuit of claim 1, wherein the first resistor and the second resistor both comprise a p-type semiconductor or both comprise a n-type semiconductor.

5. The bandgap reference correction circuit of claim 1, wherein the bandgap reference correction circuit is configured to provide a first current to the first resistor and a second current to the second resistor, wherein the first current and the second current have the same order of magnitude.

6. The bandgap reference correction circuit of claim 1, wherein the first oscillator comprises a temperature compensation module configured to set an effective resistance of the second resistor based on a temperature of the bandgap reference correction circuit.

7. The bandgap reference correction circuit of claim 6, wherein:

the first oscillator comprises a fifth resistor in parallel to the second resistor, wherein the fifth resistor is of a different type to the second resistor; and the temperature compensation circuit is configured to selectively enable the second resistor and the fifth resistor to maintain a constant effective resistance of the first oscillator in response to temperature variation.

8. The bandgap reference correction circuit of claim 1, wherein:

the bandgap reference circuit further comprises a third resistor; and the compensation module is configured to set a resistance of the third resistor based on the frequency of the first oscillator output signal.

9. The bandgap reference correction circuit of claim 8, wherein the first resistor and the third resistor form at least part of a bandgap resistor array and the second resistor is interdigitated with the bandgap resistor array.

10. The bandgap reference correction circuit of claim 9, wherein the first resistor and the third resistor both comprise a p-type semiconductor or both comprise a n-type semiconductor.

11. The bandgap reference correction circuit of claim 1, wherein the compensation module comprises:

a counter comprising:

an input terminal configured to receive the first oscillator output signal;

a reset terminal configured to receive the reference frequency signal;

and an output signal configured to output a count value of the counter; and a digital compensation module configured to:

receive the count value of the counter from the counter; and set the resistance of the first resistor based on the frequency of the first oscillator output signal.

12. The bandgap reference correction circuit of claim 1, wherein the first oscillator is a free running oscillator.

13. The bandgap reference correction circuit of claim 1, wherein the reference oscillator comprises any one of:

a crystal oscillator;

a LC oscillator; and a MEMS oscillator.

14. The bandgap reference correction circuit of claim 1, further comprising the reference oscillator.

15. The bandgap reference correction circuit of claim 1, wherein the compensation module is configured to set a resistance of the first resistor based on the frequency of the first oscillator output signal to output a constant reference voltage from the bandgap reference circuit.

16. An integrated circuit comprising the bandgap reference compensation circuit of claim 1.

17. A bandgap reference correction circuit comprising:

a bandgap reference circuit comprising a first resistor;

a first oscillator comprising a second resistor, wherein a frequency of a first oscillator output signal of the first oscillator depends on a resistance of the second resistor; and a compensation module configured to:

detect frequency changes of the first oscillator output signal; and adjust a resistance of the first resistor based on the frequency changes.

18. The bandgap reference correction circuit of claim 17, wherein the first resistor is adjacent to, proximal to or co-located with the second resistor on a semiconductor die.

19. A method for controlling a reference voltage of a bandgap reference circuit, the method comprising:

receiving a first oscillator output signal from a first oscillator, wherein a frequency of the first oscillator output signal depends on a resistance of a second resistor of the oscillator;

receiving a reference frequency signal from a reference oscillator;

determining the frequency of the first oscillator output signal using the reference frequency signal; and setting a resistance of a first resistor of a bandgap reference circuit based on the frequency of the first oscillator output signal.

20. The method of claim 19, wherein, the first resistor is adjacent to, proximal to or co-located with the second resistor on a semiconductor die.

* * * * *